United States Patent [19]

Christensen-Dalsgaard

[11] Patent Number: 4,579,510

[45] Date of Patent: Apr. 1, 1986

[54] AXIAL FLOW FAN IMPELLER

[75] Inventor: Claus Christensen-Dalsgaard, Ronnede, Denmark

[73] Assignee: Nordisk Ventilator Co. A/S, Naestved, Denmark

[21] Appl. No.: 657,901

[22] Filed: Oct. 5, 1984

[30] Foreign Application Priority Data

Oct. 7, 1983 [DK] Denmark ..... 4634/83

[51] Int. Cl.[4] ..... F04D 29/36

[52] U.S. Cl. ..... 416/135; 416/157 R; 416/205

[58] Field of Search ..... 416/205, 147, 245 B, 416/135, 156, 157 R, 157 C

[56] References Cited

U.S. PATENT DOCUMENTS

| | | | |
|---|---|---|---|
| 2,844,303 | 7/1958 | Kristiansen | 416/157 C X |
| 2,951,545 | 9/1960 | Heuver | 416/135 R X |
| 3,006,417 | 10/1961 | Busquet | 416/157 C X |
| 3,139,310 | 6/1964 | Jungstrom | 416/157 C X |
| 3,984,194 | 10/1976 | Fermer et al. | 416/167 X |

FOREIGN PATENT DOCUMENTS

| | | | |
|---|---|---|---|
| 1095454 | 12/1960 | Fed. Rep. of Germany | 416/157 C |
| 1428252 | 3/1969 | Fed. Rep. of Germany | 416/168 |
| 1503518 | 2/1970 | Fed. Rep. of Germany | 416/205 |
| 826519 | 1/1960 | United Kingdom | 416/207 |
| 903792 | 8/1962 | United Kingdom | 416/205 |
| 566968 | 8/1977 | U.S.S.R. | 416/135 R |

*Primary Examiner*—Everette A. Powell, Jr.
*Attorney, Agent, or Firm*—Sughrue, Mion, Zinn, Macpeak and Seas

[57] ABSTRACT

An axial flow fan impeller having a number of blades, which are rotatably journalled in a wheel rim (3), each with its blade root (4) which is connected with an adjusting device (10) for the blades. The wheel rim comprises as a supporting member for the blades an annular body of revolution (6) with bores (5) for the blade shafts and a cut-out for taking up a thrust bearing (7). The body of revolution is connected with the body plate (18) and the front plate (21) of the impeller through tubular connecting pieces (19, 20), which are symmetrical relative to the body of revolution and are elastically deformable by loading forces acting in the radial plane of the wheel, but have a relatively great rigidity against forces acting in the axial direction. The impeller may thus be fabricated by welding, without the occurrence of dynamic loads exceeding the allowable values for the welding joints (25, 26).

4 Claims, 6 Drawing Figures

AXIAL FLOW FAN IMPELLER

The invention relates to an impeller for an axial flow fan, comprising a wheel rim, in which a number of blades are rotatably journalled, each with a blade root connected with a blade shaft, which is connected with a common adjusting device rotating together with the wheel for turning all the blades around the axes of the blades and the blade shafts during rotation of the wheel, said wheel rim being connected through a body plate and a front plate with a hub member to be secured to a drive shaft, on one hand, and with catching members for said adjusting device, on the other hand.

Axial flow fan impellers of this kind are well known and are used, inter alia, in axial flow fans having a very great capacity.

Hitherto, the wheel rim, the body plate and the hub member have been formed in one piece as a solid cast unit in order to obtain a sufficient strength and stability of the impeller to take up the very heavy static and dynamic loads, to which it is exposed during acceleration, rotation with a constant speed of revolution and deceleration, as well as by adjustment of the pitch of blades during rotation.

It is the object of the invention to provide a construction of a fan impeller of the kind mentioned, allowing the design of even very great impellers as welded constructions composed mainly of plate-shaped and tubular parts, whereby considerable advantages with respect to production will be obtained, because impellers of this kind are often made in relatively limited numbers.

According to the invention, this object is accomplished together with a strength and stability fully satisfactory to the function of the impeller in an axial flow fan impeller, which is characterized in that said wheel rim as a supporting member for the blades comprises an annular body of revolution positioned inside the blade roots, said body being formed with radial bores for the blade shafts and with a cut-out to receive a thrust bearing and being connected with said body plate and said front plate through tubular connecting pieces, which are mainly symmetrical relative to the body of revolution and are elastically deformable by loading forces acting in the radial plane of the impeller, but have a relatively great rigidity to loading forces in the axial direction.

The invention is based on the recognition of the fact that by forming the above mentioned connection pieces, which in respect of loads are very critically positioned in the impeller, in particular in case of a welded construction, as elastically deformable elements, essentially improved properties with respect to strength and stability can be obatined than by using more conventional solutions, by which rigidity and wall thickness are increased at places exposed to particularly heavy loads.

Experiments in practice have shown that with a fan impeller according to the invention designed as a welded construction, it is possible without difficulty to keep the dynamic tensions in the impeller below the permitted values for the welding joints even at the most critical places, such as between the above mentioned body of revolution in the wheel rim and the connecting pieces.

Moreover, by means of the invention, such a stability is obtained that the regions of the wheel rim forming supporting faces for the thrust bearing in the blade suspension arrangements are kept substantially normal to the axis of the impeller and approximately in the radial symmetry plane of the impeller.

In the following, the invention is further explained with reference to the drawings, in which FIG. 1 is an axial sectional view of an embodiment of an axial flow fan impeller according to the invention;

Figure 1:
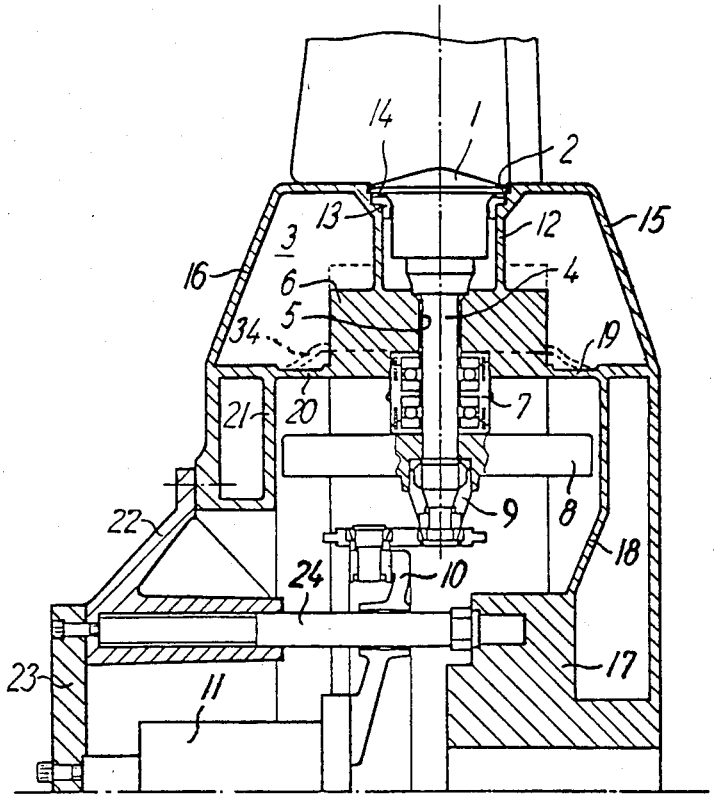

The axial sectional view in FIG. 1 shows the construction of a blade and the suspension arrangement for a single blade, which is not illustrated, and may be of a conventional design. In practice, in case of great impeller diameters, the impeller will have a considerable number of blades.

The blades are rotatably journalled, each with its blade root 1, in openings 2 in a wheen rim designaled in its entirety with 3. By means, for instance, of a bayonet engagement of the kind disclosed in applicants' copending application Ser. No. 657,902, the blade root 1 is secured on the external end of a blade shaft 4 extending through a bore 5 in an annular body of revolution 6 positioned inside the blade root 1 and serving as a supporting body for the blades. At the opening of the bore 5 at the internal side of the body of revolution 6, a blade shaft is rotatably journalled relative to the body of revolution 6 by means of a thrust bearing 7.

The bearing 7 may be designed as shown as a double bearing of the kind disclosed in International Patent Application No. PCT/DK80/00003 (WO 80/01503).

Inside the bearing 7, a pair of balancing arms 8 are secured to the blade shaft 4, and at its internal end the blade shaft 4 is connected through a control arm 9 with an adjusting disc 10, which is rotatable together with the impeller, but axially displaceable relative thereto and may be caused by means, for example, of a control force provided by a hydraulic cylinder 11 to perform an axial movement for simultaneous changing of the pitch of all the blades.

In the wheel rim 3, the openings for the blade roots 1 are defined by short tubular members 12 which are secured by welding to the external side of the body of revolution 6. At the external opening of each of these tubular pieces 12, a guide 13 matching a flange portion 14 on the blade root is provided.

At the external side, the tubular pieces 12 are, moreover, connected with shell parts 15 and 16 forming the outer circumference of the wheel rim 3 and, thereby, of the impeller.

A hub member 17 designed to be secured on a nonillustrated drive shaft is connected through a body plate 18 and a tubular connecting piece 19 with one side of the body of revolution 6 at the transition to the internal circumference thereof. On the opposite side, the body of revolution 6 is connected through another tubular connecting piece 20 with a front plate 21, to which an annular cover 22 is secured by means of bolts. Moreover, a control cover 23 is secured by means of bolts to the annular cover 22. By removal of these covers, access may be obtained to the interior of the impeller with the blade adjusting mechanism and the thrust bearings of the blade suspension arrangements.

A number of catch members 24 for the blade adjusting mechanism is secured in one end to the hub member 17 and connected in the other end with the covers 22 and 23.

Figure 2:
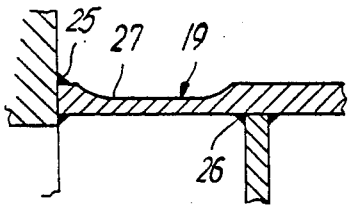
FIG. 2 is an enlarged extracted portion of FIG. 1.

Due to the design of the illustrated impeller as a welded construction, a number of welding joints are present between the different parts of the impeller. Out of these welding joints, only the welding joints 25 and 26 between each of the connecting pieces 19 and 20 and the body of revolution 6, on one hand, and the body plate 18 and the front plate 21, respectively, on the other hand, are shown in the enlarged view in FIG. 2.

In accordance with the invention, the tubular connecting pieces 19 and 20 between the body of revolution 6 and the body plate 18 and the front plate 21, respectively, are designed so as to be elastically deformable by loading forces acting in the radial plane of the impeller, whereas they have a relatively great rigidity against loading forces in the axial direction.

In the illustrated preferred embodiment, this is accomplished in that each of the connecting pieces 19 and 20 has a region 27 with a reduced wall thickness between the welding joints 25 and 26.

Figure 3:
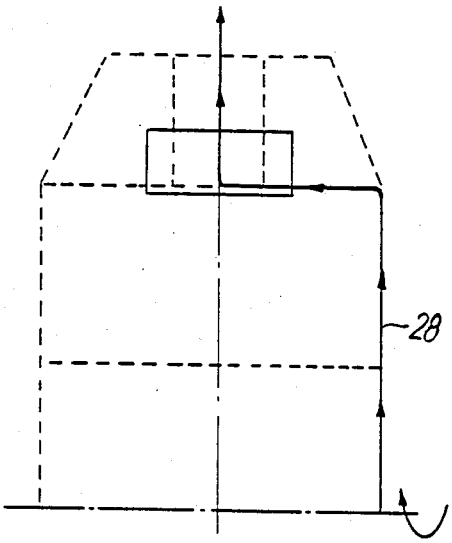
FIGS. 3 to 6 are diagrams illustrating the loading forces acting on the impeller under different load conditions.

The loading forces acting on the hub construction and the blades of the impeller comprise essentially the following loads:

(a) The torque, which is transmitted from the hub member 17 through the body plate 18, the connecting piece 19 and the body of revolution 6 to the blade shaft, such as illustrated by a solid line 28 in FIG. 3.

Figure 4:
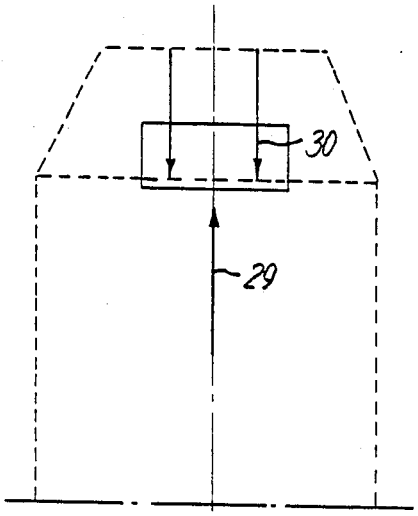

(b) The centrifugal force occurring during rotation of the impeller and amounting for great impeller dimensions and speeds of revolution to more than 50 tons per blade. This force, shown at 29 in FIG. 4, acts mainly on the body of revolution 6 and the blade suspension arrangements and causes reaction forces, as shown at 30, which are taken up in the body of revolution 6. The radial deformation, to which the body of revolution 6 is thereby exposed, must be taken up by the connection pieces 19 and 20, so that they are only transferred to a small extent to the body plate 18 and the front plate 21.

Figure 5:
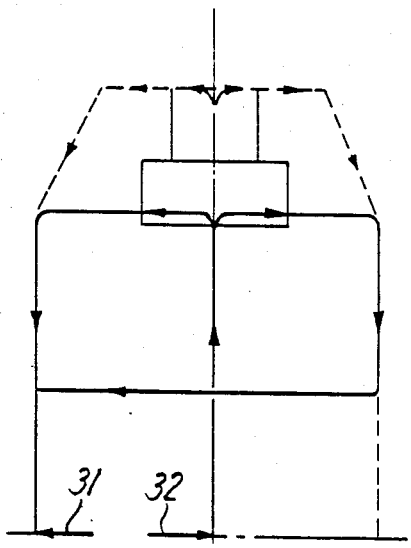

(c) The adjustment force for the blade pitch adjustment acts in the axial direction, as shown at 31 and 32 in FIG. 5, and is transferred through the adjusting disc 10, the blade shaft 4 and the body of revolution 6, and therefrom to the connecting pieces 19 and 20. Reaction forces in the form of transverse forces acting on the blades are mainly transferred through the connecting pieces 19 and 20 to the body plate 18 and the front plate 21.

Figure 6:
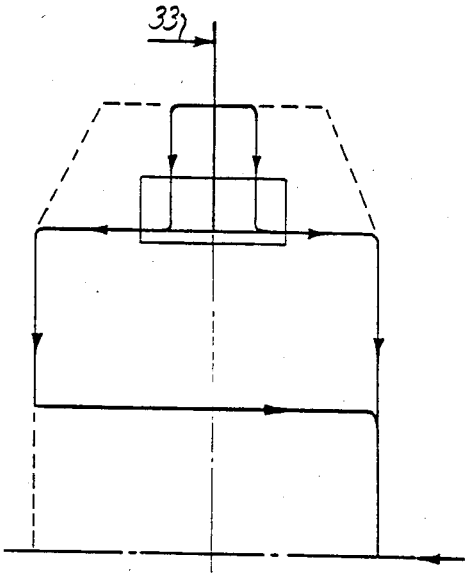

(d) The reaction force or air force arising during rotation of the fan impeller as a buoyant force which, as shown at 33 in FIG. 6, acts normal to the direction of incoming air flow is primarily transferred from the blade shaft 4 through the body of revolution 6 and the connecting pieces 19 and 20 to the remaining hub parts.

Out of the above mentioned loading forces, the centrifugal force constitutes by far the greatest deformative load. With respect to this load, the design of the connecting pieces 19 and 20 characteristic of the invention so as to be elastically deformable against loading forces in the radial plane implies that the static load from the centrifugal force is taken up to the far greater extent by the supporting body of revolution 6 and is only transferred to a smaller extent to the remaining hub parts designed as welded constructions, since the elastic deformability of the connecting pieces 19 and 20 in the radial direction allows a deflection, such as shown at a somewhat enlarged scale by dashed lines 34 in FIG. 1, without exceeding the allowable tensions in the welding joints 25 and 26.

The essential dynamic load arises due to the adjusting force, which is provided by the adjusting device 11 during rotation of impeller for changing the pitch of the blades. In order to avoid axial load acting on the main bearings of the impeller, this force, the magnitude of which depends mainly on the friction in the thrust bearings 7, must be taken up in the hub construction itself. By far greater part of the adjusting force is taken up in the catching members 24 for the blade adjusting mechanism and in the connecting pieces 19 and 20, since these elements constitute the most rigid elements of the hub in the axial direction. The adjusting force is transferred by the catching members 24 to the body plate 21 through the covers 22 and 23. However, the design of the connecting pieces 19 and 20 to be elastically deformable, whereby the far greatest static load will be taken up in the supporting body of revolution 6, as mentioned above, implies that the adjusting force and the reaction forces caused thereby are transferred between the body of revolution 6 and the remaining hub parts without giving rise to harmful dynamic loads in the welding joints 25 and 26.

Finally, the design of the tubular connecting pieces 19 and 20 implies a relatively great torsional resistance for transferring the torque from the main shaft of the impeller to the blades.

In addition, the mainly symmetrical design of the connecting pieces 19 and 20 implies an equal distribution of the static and dynamic loads substantially symmetrical relative to the radial loading symmetry plane of the impeller. As a result thereof, the internal side of the supporting annular body of revolution 6 and the abutment surface for the thrust bearing 7 positioned at the opening af the bore 5 will always be kept normal to the radial plane corresponding to a direction of the axis of the thrust bearing 7 normal to the axis of the impeller, so that the blade bearings are not exposed to displacements relative to the radial plane.

I claim:

1. An impeller for an axial flow fan, comprising a wheel rim (3), in which a number of blades are rotatably journalled, each with a blade root (1) connected with a blade shaft (4) which is connected with a common adjusting device (10) rotating together with the wheel for turning all the blades around the axes of the blades and the blade shafts (4) during rotation of the wheel, said wheel rim (3) being connected through a body plate (18) and a front plate (21) with a hub member (17) to be secured to a drive shaft, on one hand, and with catching members (24) for said adjusting device (10), on the other hand, characterized in that said wheel rim (3) as a supporting member for the blades comprises an annular body of revolution (6) positioned inside the blade roots (1), said body being formed with radial bores (5) for the blade shafts (4) and with a cut-out to receive a thrust bearing (7) and being connected with said body plate (18) and said front plate (21) through tubular connecting pieces (19, 20), which are mainly symmetrical relative to the body of revolution and are elastically deformable by loading forces acting in the radial plane of the impeller, but have a relatively great rigidity to loading forces in the axial direction.

2. An axial flow fan impeller as claimed in claim 1, characterized in that for each blade, said body of revolution (6) is connected at its external side with a radial tubular piece (12) which is formed at its external opening as a seat for a guide portion (13) of the blade root.

3. An axial flow fan impeller as claimed in claim 1 or 2, characterized in that the tubular connecting pieces (19, 20) have a region (27) of reduced wall thickness between the body of revolution and the body and front plate, respectively.

4. An axial flow fan impeller as claimed in claim 3, characterized in that the impeller is designed as a welded construction of mainly plate-shaped and tubular parts, and that said region (27) of the tubular-connecting pieces are positioned between the welding joints (25, 26) of the tubular-connecting pieces relative to the body of revolution (6) and the body plate (18) or the front plate (21), respectively, and are symmetrical relative to the body of revolution (6).

* * * * *